US006862356B1

(12) United States Patent
Makino

(10) Patent No.: US 6,862,356 B1
(45) Date of Patent: Mar. 1, 2005

(54) AUDIO DEVICE

(75) Inventor: Atsushi Makino, Saitama (JP)

(73) Assignee: Pioneer Corporation, Tokyo (JP)

( * ) Notice: Subject to any disclaimer, the term of this patent is extended or adjusted under 35 U.S.C. 154(b) by 755 days.

(21) Appl. No.: 09/592,575

(22) Filed: Jun. 12, 2000

(30) Foreign Application Priority Data

Jun. 11, 1999 (JP) ..... P.11-165651
Apr. 20, 2000 (JP) ..... P.2000-119787

(51) Int. Cl.[7] ..... H04R 5/00; H04R 5/02

(52) U.S. Cl. ..... 381/1; 381/302; 381/17
(58) Field of Search ..... 381/1, 302, 17

(56) References Cited

U.S. PATENT DOCUMENTS 5,187,692 A * 2/1993 Haneda et al. ..... 367/135
5,467,401 A * 11/1995 Nagamitsu et al. ..... 381/63
5,604,809 A * 2/1997 Tsubonuma et al. ..... 381/17
5,727,066 A * 3/1998 Elliott et al. ..... 381/1
5,862,227 A * 1/1999 Orduna-Bustamante et al. ..... 381/17
6,222,930 B1 * 4/2001 Nakano et al. ..... 381/307
6,243,476 B1 * 6/2001 Gardner ..... 381/303

* cited by examiner

*Primary Examiner*—Forester W. Isen
*Assistant Examiner*—Devona E. Faulk
(74) *Attorney, Agent, or Firm*—Sughrue Mion, PLLC

(57) ABSTRACT

A dummy listener and right and left speakers 13 and 14 are disposed in an anechoic room as a model of the layout of those a car cabin 15 or the like. Transfer functions ALL, ALR, ARL and ARR in a space ranging from the speakers 13 and 14 to the right and left ears of a listener 16 in a car cabin 15 or the like are calculated from impulse response series aLL(t) to aRR(t) obtained when pulse sounds are respectively emitted from the speakers 13 and 14. A correction circuit 10*b* contains correction transfer functions H11, H12, H21 and H22, which are obtained by an inverse matrix of a 2-row and 2-column regular matrix of which the elements are the transfer functions ALL, ALR, ARL and ARR. Audio signals SL and SR on which head related transfer functions are superimposed are applied to the correction circuit 10*b*, and the output signals of the correction circuit 10*b* are supplied to the speakers 13 and 14.

3 Claims, 15 Drawing Sheets

FIG. 14

| | TRANSFER FUNCTION DATA | | | |
|---|---|---|---|---|
| CODE OF HEARING POSITION | H11 | H12 | H21 | H22 |
| W | aa11 | aa12 | aa21 | aa22 |
| X | bb11 | bb12 | bb21 | bb22 |
| Y | cc11 | cc12 | cc21 | cc22 |
| Z | dd11 | dd12 | dd21 | dd22 |

FIG. 15

| CODE OF HEARING POSITION | TEN KEYS |
|---|---|
| W | ① ② ③ |
| X | ④ ⑤ ⑥ |
| Y | ⑦ ⑧ ⑨ |
| Z | * |

AUDIO DEVICE

BACKGROUND OF THE INVENTION

The present invention relates to an audio device which corrects a delocalization of a center sound image or an asymmetrical expansion of a sound field in a reproduction sound field, such as a car cabin or a listening room, to thereby provide a natural sound space to listeners.

In a conventional audio device, right- and left-channel speakers 5 and 6 are disposed in a reproduction sound field space 4, such as a listening room, as typically shown in FIG. 17A. When a listener hears a stereophonic sound or the like at the center in front of the speakers 5 and 6, a center sound image C, such as vocal, is localized in front of the listener. When the listener listens at a position asymmetrically located with respect to the speakers 5 and 6, the center sound image C is delocalized, thereby failing to produce a natural sound field space.

A car-carried audio device is known as a typical case where the center sound image C is likely to be delocalized. The car-carried audio device is used in a special place, viz., within a car cabin of an automobile. Accordingly, it is common practice that the left- and right-channel speakers 1 and 2, as typically shown in FIG. 17B, are disposed at a position located asymmetrical with respect to a passenger (listener) Therefore, the center sound image C, such as vocal, to be localized in front of the listener is delocalized to a position closer to the speaker 2 disposed closer to the listener.

To cope with the delocalization problem of the center sound image within the car cabin, there is proposed car-carried audio devices with a balance adjustment function and a time alignment function.

In the car-carried audio device with the balance adjustment function, as shown in FIG. 17C, an output level of the speaker 2 located closer to the listener is reduced to be lower than the output level of the speaker 1 located farther from the listener by an amplitude adjustment circuit 7. As a result, the sound pressure levels of the right- and left-channels are balanced with respect to the listener to localize the center sound image C in front of the listener.

In the car-carried audio device with the time alignment function, as shown in FIG. 17D, an audio signal is supplied to the speaker 1 located farther from the listener, and after some time elapses, an audio signal is supplied to the speaker 2 closer to the listener, whereby the right- and left-channel sounds reach the listener at the same time, and the center sound image C is localized in front of the listener.

A head related transfer function (HRTF) correction method is known. In the HRTF basis correction method, a sound field of a concert hall or the like is simulated or a sound image is localized in a desired direction by controlling a transfer function (amplitude and phase characteristics) of a space between a speaker and the ears of a listener. Attempt has been made to correct a delocalization of a sound image or to enlarge a sound field by applying the HRTF correction method to the car-carried audio device.

The audio devices with the balance adjusting function and the time alignment function are capable of localizing the center sound image in front of the listener, indeed. However, it is difficult to remove the asymmetric expansion of a sound field as viewed in the horizontal direction.

In the case of using the head related transfer functions, a great amount of audio signals must be digital processed for an extremely short time. Therefore, the signal processing circuit of a large scale and high speed is required.

FIR (Finite Impulse Response) digital filters, for example, are used for the signal processing circuits to realize the head related transfer functions. In this case, a great number of filter coefficients and delay elements are required so as to satisfactorily correct complicated sound field characteristics. Increase of the circuit scale and processing speed is unavoidably imparted on the signal processing circuit.

Even if the deformation of the sound field is corrected by the HRTF basis correction method which uses the signal processing circuit of large scale and high speeds, the correction is effective only under limited conditions. If the listener is constantly static, the transfer functions in a space ranging from the right and left speakers to the right and left ears of the listener including his head remain unchanged. Therefore, the correction improvement is achieved under that condition. Actually, in the car-carried audio device, the listener frequently moves his head in the driving operation, and in the audio device installed in a living room, the listener is not always static. Accordingly, the transfer functions in a space from the right and left speakers to the listener vary, and it is impossible to quickly change the head related transfer functions following the distance change.

SUMMARY OF THE INVENTION

The present invention has been made to solve the above problems, and an object of the invention is to provide an audio device which provides a natural sound field to a listener by correcting a delocalization of a center sound image and an expanding asymmetrically as viewed in the horizontal direction in a reproduction sound field.

To achieve the above object, there is provided an audio device having a correction circuit having given transfer functions, which audio device supplies, through the correction circuit, right- and left-channel input audio signals on which head related transfer functions are superimposed, to right- and left-channel speakers located in front of a hearing position of a listener in a reproduction sound field space. The audio device is improved in that correction transfer functions obtained by an inverse matrix of a matrix of which the elements are the following first to fourth transfer functions are implanted in the correction circuit; a first transfer function featured by a sound field characteristic of a space ranging from a left-channel speaker to the left ear of the listener when the left-channel speaker is disposed in an anechoic room as a model of a component layout in the reproduction sound field space, a second transfer function featured by a sound field characteristic of a space ranging from a left-channel speaker to the right ear of the listener when the left-channel speaker is disposed in an anechoic room as a model of a component layout in the reproduction sound field space, a third transfer function featured by a sound field characteristic of a space ranging from a right-channel speaker to the left ear of the listener when the right-channel speaker is disposed in an anechoic room as a model of a component layout in the reproduction sound field space, and a fourth transfer function featured by a sound field characteristic of a space ranging from a right-channel speaker to the right ear of the listener when the right-channel speaker is disposed in an anechoic room as a model of a component layout in the reproduction sound field space.

The correction transfer functions of the correction circuit have the called inverse characteristics of transfer functions featured by sound field characteristics in a space ranging from the speakers of both channels. When audio signals are input to the correction circuit, the correction circuit corrects the input audio signals so as to suppress the influence by the sound field characteristics, and supplies the corrected ones to the speakers of both channels. Therefore, the influence of a delocalization of a center sound image of sounds generated by the speakers, an expanding asymmetrically as viewed in the horizontal direction in a reproduction sound field, and the like are cancelled by the reproduction sound field characteristics. Therefore, the listener hears sounds equivalent to the sounds reproduced from the input audio signals on which head related transfer functions defined when he hears sounds in a sound field.

According to another aspect of the invention, there is provided an audio device comprising a correction circuit having given transfer functions, which audio device supplies, through the correction circuit, right- and left-channel input audio signals on which head related transfer functions are superimposed, to right- and left-channel speakers located in front of a hearing position of a listener in a reproduction sound field space. In the audio device, correction transfer functions, which are obtained in accordance with a plurality of spatial regions within a predetermined reproduction sound field space by an inverse matrix of a matrix of which the elements are the following first to fourth transfer functions are implanted in the correction circuit are determined in advance; the first transfer function featured by a sound field characteristic of a space ranging from a left-channel speaker to the left ear of the listener when the left-channel speaker is disposed in an anechoic room as a model of a component layout in the reproduction sound field space, the second transfer function featured by a sound field characteristic of a space ranging from a left-channel speaker to the right ear of the listener when the left-channel speaker is disposed in an anechoic room as a model of a component layout in the reproduction sound field space, the third transfer function featured by a sound field characteristic of a space ranging from a right-channel speaker to the left ear of the listener when the right-channel speaker is disposed in an anechoic room as a model of a component layout in the reproduction sound field space, and the fourth transfer function featured by a sound field characteristic of a space ranging from a right-channel speaker to the right ear of the listener when the right-channel speaker is disposed in an anechoic room as a model of a component layout in the reproduction sound field space. Further, the audio device comprises: storing means for storing correction transfer functions corresponding to a plurality of spatial regions; and position detecting means for specifying a hearing position of the listener in the plurality of spatial regions, wherein of the correction transfer functions stored in the storing means, the correction transfer functions specified according to a hearing position of the listener detected by the position detecting means are implanted in the correction circuit.

When a hearing position of the listener is changed, the position detecting means applies the correction transfer functions based on the changed hearing position. Therefore, the listener hears a stereophonic reproduction sound while being unconscious of the hearing position.

BRIEF DESCRIPTION OF THE DRAWINGS

FIG. 14 is an explanatory diagram for explaining the function of the remote controller.

FIG. 15 is a diagram typically showing data stored in a storage unit.

DETAILED DESCRIPTION OF THE PREFERRED EMBODIMENTS

The preferred embodiments of an audio device according to the invention will be described in detail with reference to the accompanying drawings.

(1st Embodiment)

Figure 1:
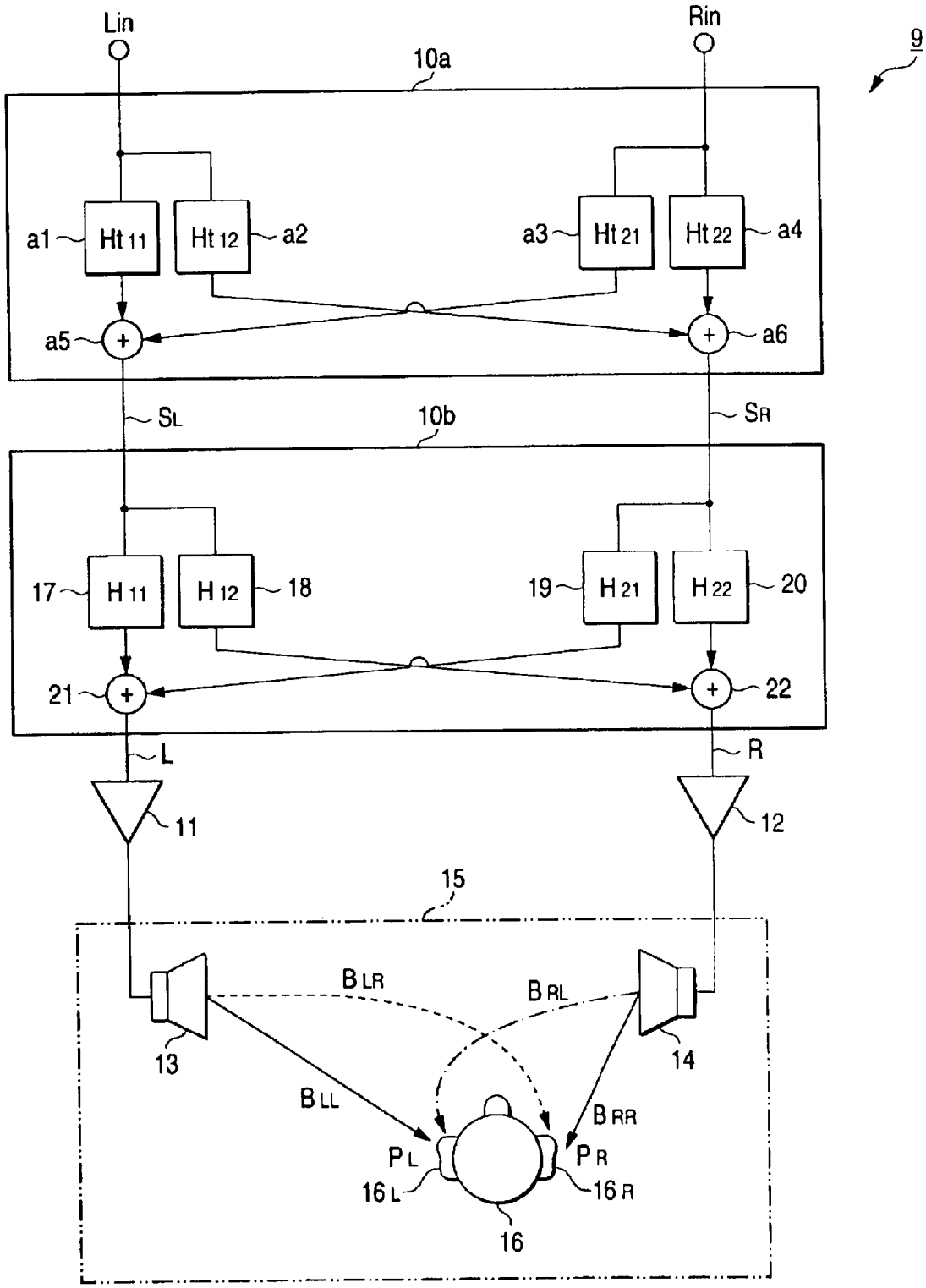
FIG. 1 is a block diagram showing an arrangement of an audio device 9 which is a first embodiment of the present invention.

FIG. 1 is a block diagram showing an arrangement of an audio device 9 which is a first embodiment of the present invention. While the invention is not limited to a home use audio device, a car-carried audio device or the like, the invention will be described in the form of a car-carried audio device 9, for ease of explanation.

In FIG. 1, the audio device 9 is made up of a head related transfer function (HRTF) circuit 10*a*, a correction circuit 10*b*, output amplifiers 11 and 12, and a couple of speakers 13 and 14 attached to the inside of a car cabin 15. The speakers 13 and 14 are located at the right and left positions with respect to a passenger (listener) 16, for example, the right and left side positions on a front dashboard in the car cabin 15 or the front doors.

The HRTF circuit 10*a* includes operator-circuits a1 to a4 and adder circuits a5 and a6. The HRTF circuit 10*a* superimposes amplitude/phase characteristics or head related transfer functions, which are equivalent to those defined when a listener hears a sound in a sound field, onto input audio signals Lin and Rin, by use of the operator circuits a1 to a4 and the adder circuits a5 and a6.

More specifically, audio signals Lin and Rin of right and left channels, which are generated by a reproduction or playback device as a sound source coupled to the audio device 9, such as a CD (compact disc) or MD (mini disc) reproduction or playback device for reproducing or playing back a sound from a recording medium, such as a CD or an MD, in which an audio source is recorded in a sound field in a concert hall, a recording studio or the like, are input to the operator circuits a1 to a4 of the HRTF circuit, as shown. The output signals of those operator circuits a1 to a4, which have respectively transfer functions Ht11, Ht12, Ht21, and Ht22, are added by the adder circuits a5 and a6, whereby the audio device 9 generates right- and left-channel audio signals SL and SR on which the head related transfer functions defined when the listener hears a sound in a sound field are superimposed.

The transfer functions, which are implanted in the operator circuits a1 to a4, are not the transfer functions in a space ranging from a sound source to sound recording microphones when only the microphones are located in a sound field, but the transfer functions Htl1, Ht12, Ht21, and Ht22 in a sound field, which are equivalent to those where a listener actually hears a sound by his right and left ears inclusive of his head.

More specifically, the transfer functions H11, Ht12, Ht21, and Ht22 are obtained by the inverse matrix of a regular matrix containing the following elements: a sound field characteristic of a space between a sound source located on the left side of a listener and the left ear of the listener; a sound field characteristic of a space between the sound source on the left side of the listener and the right ear; a sound field characteristic in a space between a sound source located on the right side of the listener to the left ear; and a sound field characteristic in a space from a sound source located on the right side of the listener to the right ear. In this way, the above-mentioned head related transfer functions inclusive of the listener's head are realized.

The correction circuit 10*b* carries out a correction process to be given later for correcting the audio signals SL and SR on which the head related transfer functions defined when the listener hears sounds in a sound field. Right- and left-channel audio signals L and R, which are generated (output) as the result of the correction process are supplied to the right and left speakers 13 and 14, through the output amplifiers 11 and 12.

The audio signals SL and SR that are input to the correction circuit 10*b* are digital audio signals, which are digitized at a given sampling frequency although not illustrated. Those digital audio signals are subjected to the correction process mentioned above. The digital audio signals thus corrected are converted into analog audio signals by a D/A converter (not shown), and input to the output amplifiers 11 and 12.

Next, the correction circuit 10*b* will be described in detail. The correction circuit 10*b* contains operator circuits 17 to 20 each formed with an infinite impulse response (IIR) digital filter for carrying out the correction process.

The operator circuits 17 and 18 receives the audio signal SL, and the operator circuits 19 and 20 receive the audio signal SR. The output signals of the operator circuits 17 and 19 are added together by an adder circuit 21, to thereby generate a left-channel audio signal L. The output signals of the operator circuits 18 and 20 are added together by an adder circuit 22 to generate a right-channel audio signal R.

Transfer functions H11, H12, H21 and H22 (referred to as correction transfer functions) are implanted in the operator circuits 17 to 20. Meanwhile, when sounds are emitted from the speakers 13 and 14 and reach the right and left ears 16L and 16R of the listener 16, the sounds are adversely affected by the sound field characteristic within the car cabin 15. The transfer functions are designed so as to suppress such adverse influences. A design process of those operator circuits will described.

A model of a layout of the speakers, and the listener in the car cabin 15 is formed. A dummy listener 16 and the right and left speakers 13 and 14 are disposed within an anechoic room 23 in accordance with the cabin model.

Figure 4A:
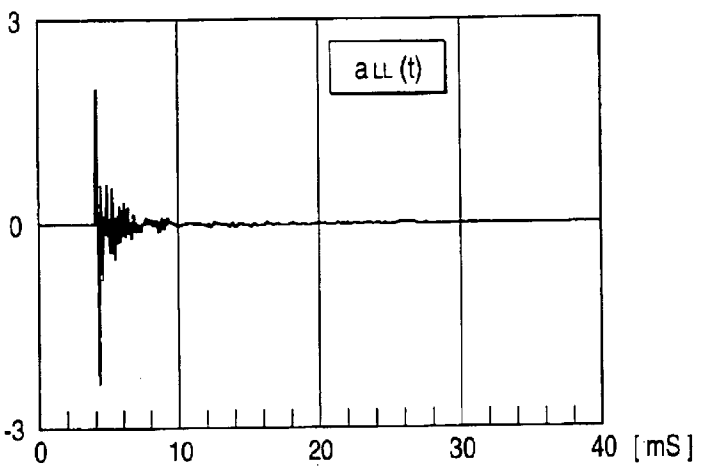
FIGS. 4A to 4D are graph exemplarily showing waveforms of impulse response series measured in an anechoic room, with the ordinate representing an amplitude of the impulse response and the abscissa representing time.
Figure 4B:
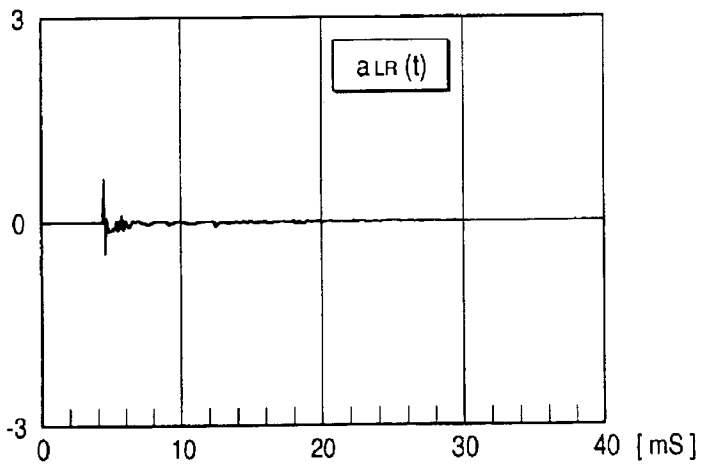

In this state, only the speaker 13 is driven to generate a pulse sound. A sound which reaches the left ear 16L of the listener and a sound which reaches the left ear 16R of the listener are gathered by microphones, respectively. An impulse response series aLL(t) in a space between the speaker 13 and the left ear 16L as shown in FIG. 4A and an impulse response series aLR(t) in a space between the speaker 13 and the right ear 16R as shown in FIG. 4B are measured.

Figure 5C:
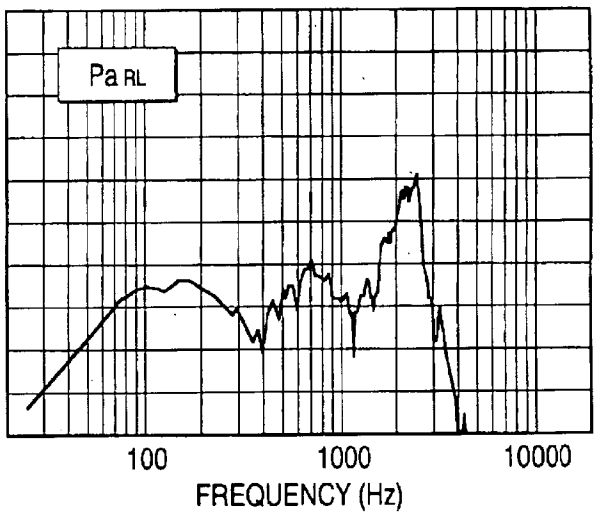
FIGS. 5A to 5D are graph showing the frequency characteristics of the impulse response series shown in FIG. 4, with the ordinate representing power and the abscissa representing frequency.
Figure 5D:
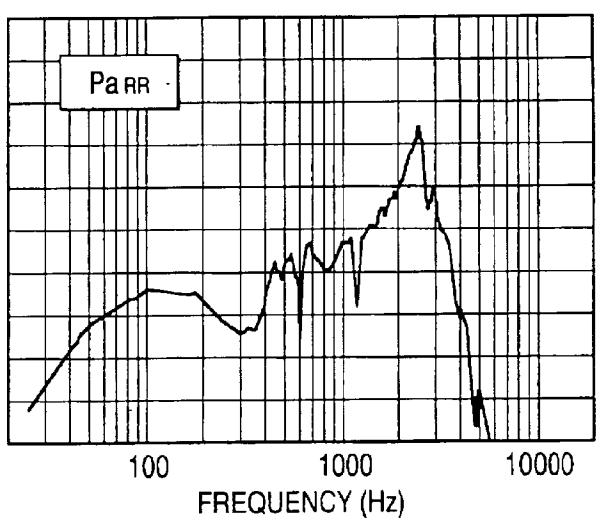
Figure 5A:
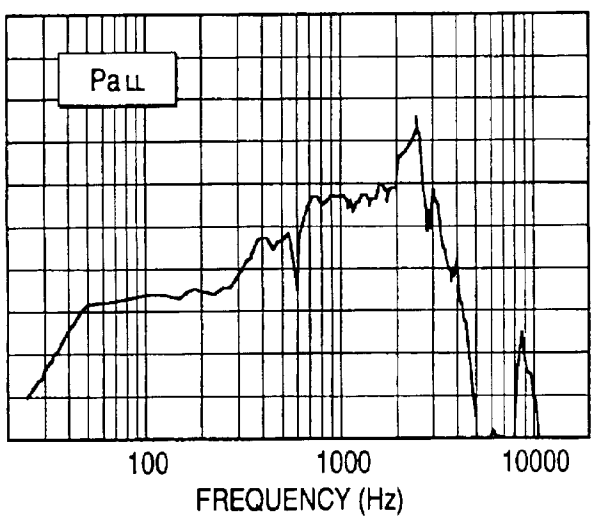
Figure 5B:
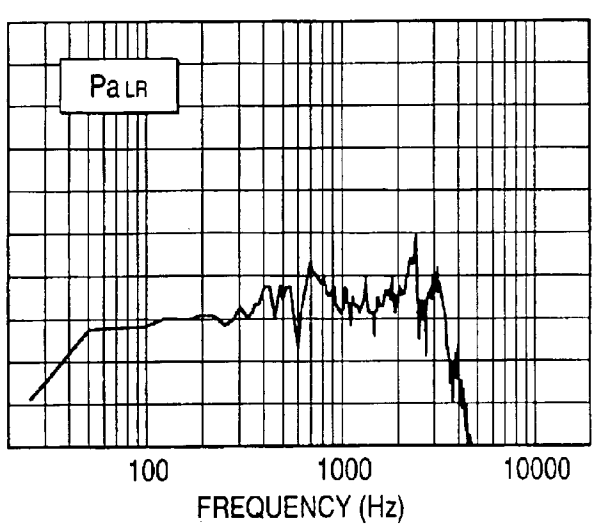
Figure 6A:
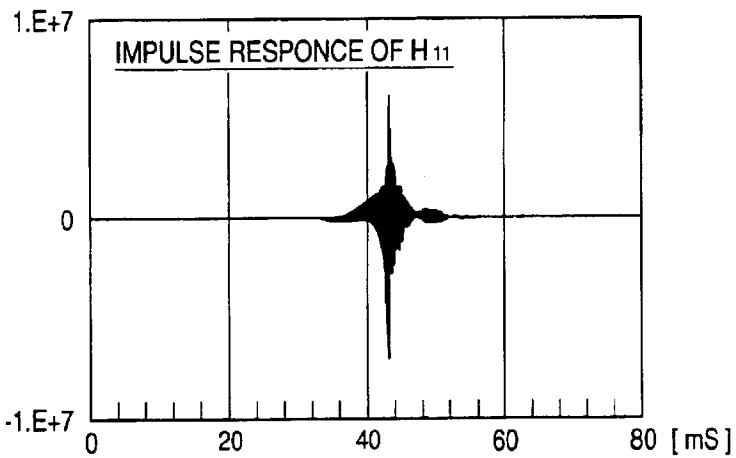
FIGS. 6A to 6D are graph exemplarily showing waveforms of impulse response series of the operator circuits in thefirst embodiment, with the ordinate representing an amplitude of the impulse-response and the abscissa representing time.
Figure 6B:
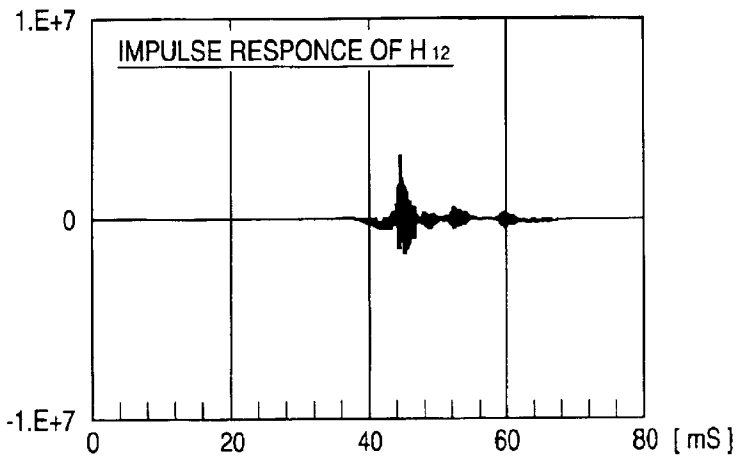
Figure 6C:
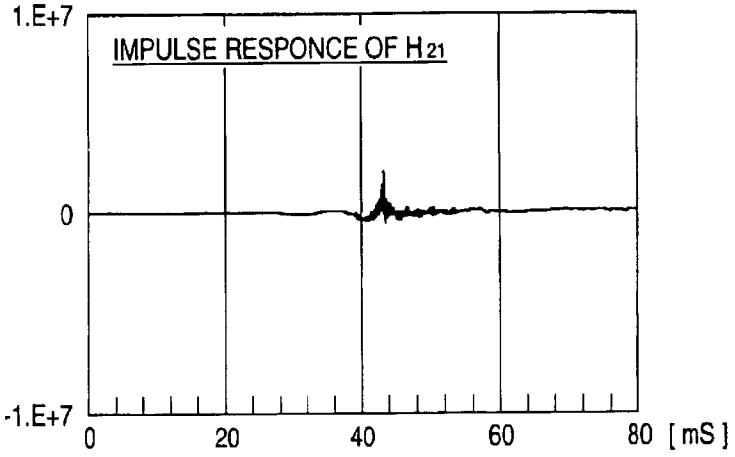
Figure 6D:
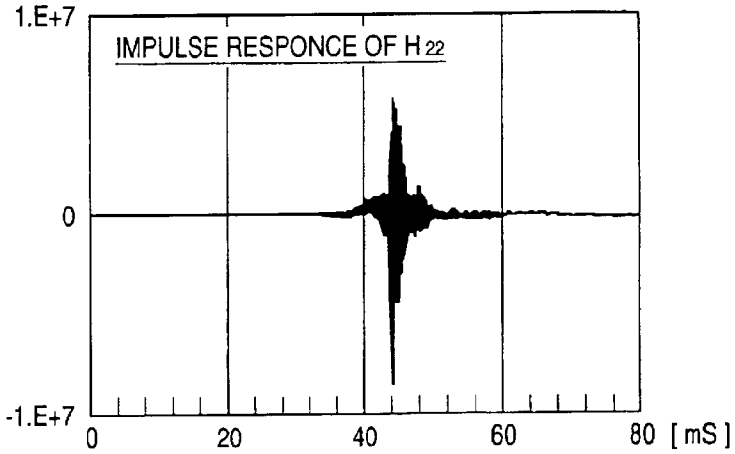
Figure 7A:
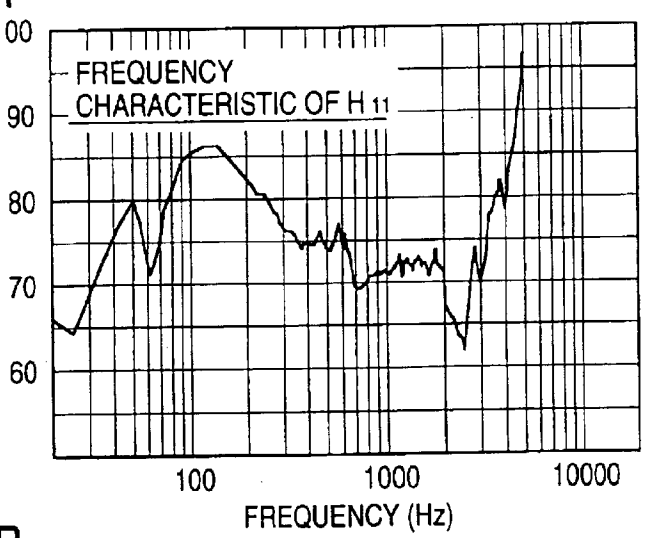
FIGS. 7A to 7D are graph showing the frequency characteristics of the impulse response series shown in FIG. 6, with the ordinate representing power and the abscissa representing frequency.
Figure 7B:
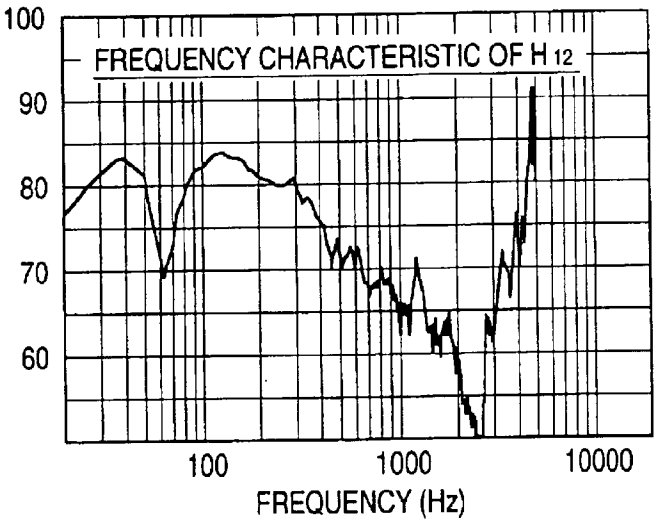
Figure 7C:
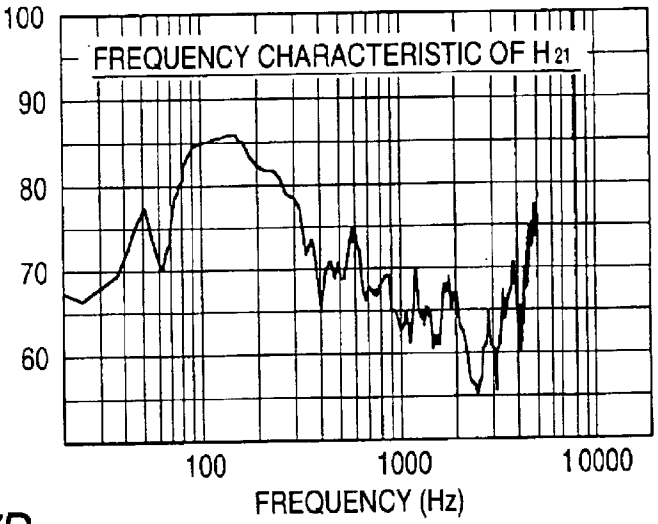
Figure 7D:
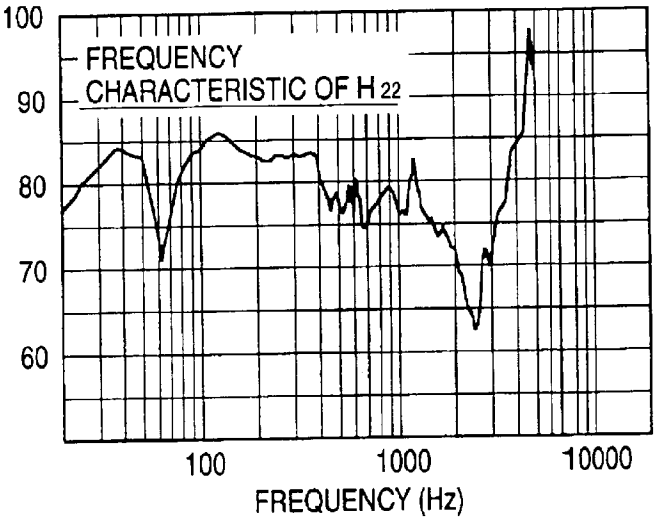

Then, the impulse response series aLL(t) is Fourier transformed into a frequency characteristic PaLL (referred to as a transfer function ALL) as shown in FIG. 5A. The impulse response series aLR(t) is also Fourier transformed into a frequency characteristic PaLR (referred to as a transfer function ALR) as shown in FIG. 5B.

Figure 4C:
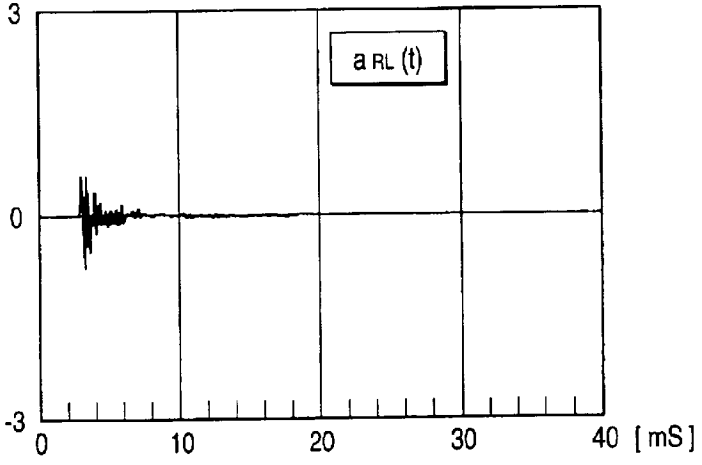
Figure 4D:
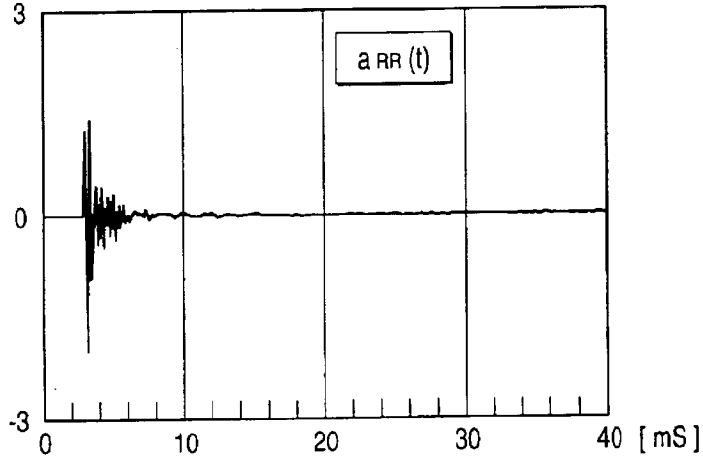

A sound pulse is emitted from only the right speaker 14, and a sound reaching the right ear 16R and a sound reaching the right ear 16R are gathered by the microphone. An impulse response series aRL (t) in a space between the speaker 14 and the left ear 16L as shown in FIG. 4C and an impulse response series aRR(t) in a space between the speaker 14 and the right ear 16R as shown in FIG. 4D are measured.

Then, the impulse response series aRL (t) is Fourier transformed into a frequency characteristic PaRL (referred to as a transfer function ARL), and the impulse response series aRR(t) is Fourier transformed into a frequency characteristic PaRL (referred to as a transfer function ARR).

An inverse matrix A-1 of a 2-row and 2-column regular matrix A of which the elements are the transfer functions ALL, ALR, ARL and ARR is obtained. The elements of the inverse matrix are used as correction transfer functions H11, H12, H21 and H22 of the operator circuits 17 to 20. The correction transfer functions H11, H12, H21 and H22 are given by the following equations (1) to (5).

[Formula 1]

$$\begin{pmatrix} H_{11} & H_{21} \\ H_{12} & H_{22} \end{pmatrix} = \begin{pmatrix} A_{LL} & A_{RL} \\ A_{LR} & A_{RR} \end{pmatrix}^{-1} = \begin{pmatrix} \dfrac{A_{RR}}{A_{LL}A_{RR} - A_{RL}A_{LR}} & \dfrac{-A_{RL}}{A_{LL}A_{RR} - A_{RL}A_{LR}} \\ \dfrac{-A_{LR}}{A_{LL}A_{RR} - A_{RL}A_{LR}} & \dfrac{A_{LL}}{A_{LL}A_{RR} - A_{RL}A_{LR}} \end{pmatrix} \tag{1}$$

$$H_{11} = \frac{A_{RR}}{A_{LL}A_{RR} - A_{RL}A_{LR}} \tag{2}$$

$$H_{12} = \frac{-A_{LR}}{A_{LL}A_{RR} - A_{RL}A_{LR}} \tag{3}$$

-continued $$H_{21} = \frac{-A_{RL}}{A_{LL}A_{RR} - A_{RL}A_{LR}} \quad (4)$$

$$H_{22} = \frac{A_{LL}}{A_{LL}A_{RR} - A_{RL}A_{LR}}. \quad (5)$$

The correction transfer functions H11, H12, H21 and H22 are realized by use of IIR (infinite impulse response) digital filters, and those filters are incorporated into the operator circuits 17 to 20, respectively.

Impulse responses of the operator circuits 17 to 20 having the correction transfer functions H11, H12, H21 and H22 thus calculated are as shown in FIGS. 6A to 6D. Those impulse responses are Fourier transformed into transfer functions (frequency characteristics) over the frequency regions as shown in FIGS. 7A to 7D.

The correction circuit 10*b* is constructed as described above. The head related transfer functions defined when the listener hears sounds in a sound field are superimposed on the right- and left-channel audio signals emitted from a sound source device, to thereby form the stereophonic audio signals SL and SR. Those stereophonic audio signals are actually input to the speakers 13 and 14 in a car cabin 15, through the correction circuit 10*b*. Then, the following effects will be produced.

Assuming that a transfer function of a space from the speaker 13 to the left ear 16L of the listener 16 within an actual car cabin 15 in FIG. 1, is BLL, a transfer function from the speaker 13 to the right ear 16R is BLR, a transfer function from the speaker 14 to the right ear 16R is BLL, and a transfer function from the speaker 14 to the right ear 16R is BRR, and a sound reaching the left ear 16L of the listener 16 is PL, and a sound reaching the right ear 16R is PR, then the following matrix formula (6) holds.

[Formula 2]

$$\begin{vmatrix} P_L \\ P_R \end{vmatrix} = \begin{vmatrix} B_{LL} & B_{RL} \\ B_{LR} & B_{RR} \end{vmatrix} \begin{vmatrix} H_{11} & H_{21} \\ H_{12} & H_{22} \end{vmatrix} \begin{vmatrix} S_L \\ S_R \end{vmatrix} \quad (6)$$

Figure 2:
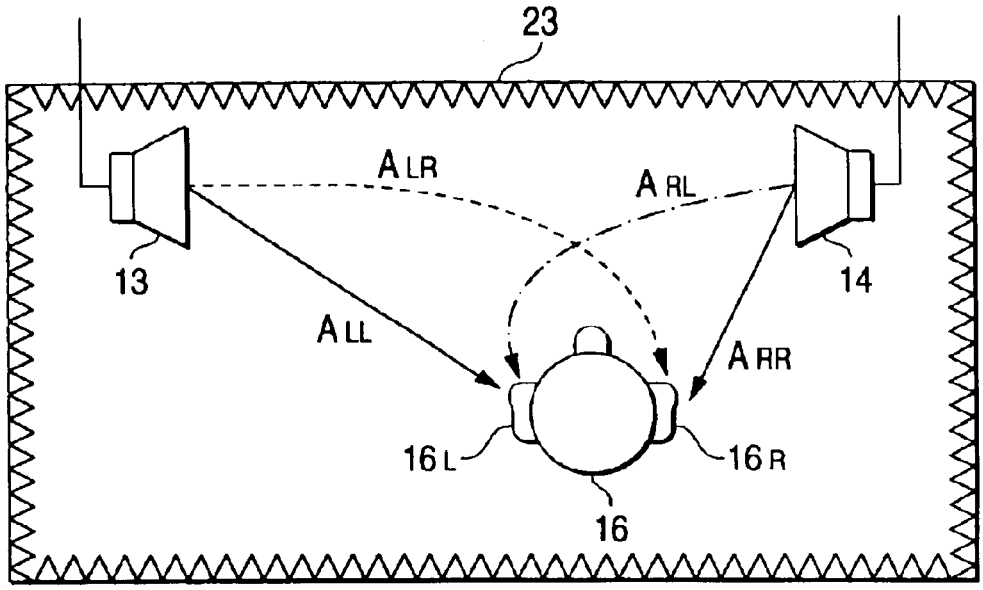
FIG. 2 is an explanatory diagram for explaining a method of setting the transfer functions of the operator circuits.

Here, the correction transfer functions H11, H12, H21 and H22 are defined by the inverse matrix of the regular matrix A of which the elements are the transfer functions ALL, ALR, ARL, ARR in the sound field shown in FIG. 2. When the audio signals SL and SR are applied to the correction circuit 10*b*, the sound field characteristic of the car cabin 15 is cancelled (corrected) by those correction transfer functions H11, H12, H21 and H22. Therefore, the listener 16 hears sounds equivalent to those reproduced from the audio signals SL and SR on which the head related transfer functions defined when the listener hears in a sound field. Accordingly, the center sound image is localized in front of the listener 16, and the listener hears the sounds in a sound field expanding symmetrically with respect to the listener in the horizontal direction.

The correction transfer functions H11, H12, H21 and H22 are constructed on the basis of the impulse response series aLL(t) to aRR(t) of relatively simple waveforms as shown in FIGS. 4A to 4D, which are measured in the anechoic room 23 as a model of the car cabin 15. The correction circuit 10*b* may be constructed by use of simple IIR digital filters, while in the conventional technique, the transfer functions for correcting the sound characteristic of the whole car cabin 15 is constructed by use of the head related transfer function correction method.

(Second Embodiment)

A second embodiment of the present invention will be described with reference to the accompanying drawings. A car-carried audio device will be described as a preferred embodiment of the invention.

An audio device of the second embodiment resembles in construction the: audio device 9 shown in FIG. 1.

In the second embodiment, the correction transfer functions H11, H12, H21 and H22 of the operator circuits 17 to 20 are constructed on an algorithm different of the first embodiment. The following method is used for constructing those operator circuits.

As in the case shown in FIG. 2, a model of: a layout of the speakers, and the listener in the car cabin 15 is formed. A dummy listener 16 and the right and left speakers 13 and 14 are disposed within an anechoic room 23 in accordance with the cabin model. In this state, only the left speaker 13 located in the anechoic room 23 is driven to emit a pulse sound. In this state, only the speaker 13 disposed in the anechoic room 23 is driven to generate a pulse sound. A sound which reaches the left ear 16L of the dummy listener 16 and a sound which reaches the left ear 16R are gathered by microphones, respectively. Impulse response series aLL(t) and aLR(t) as shown in FIGS. 4A and 4B are measured.

Further, only the right speaker 14 located in the anechoic room 23 is driven to emit a pulse sound. In this state, only the speaker 13 disposed in the anechoic room 23 is driven to generate a pulse sound. A sound which reaches the left ear 16L of the dummy listener 16 and a sound which reaches the left ear 16R are gathered by microphones, respectively. Impulse response series aLL(t) and aLR(t) as shown in FIGS. 4C and 4D are measured.

Figure 3:
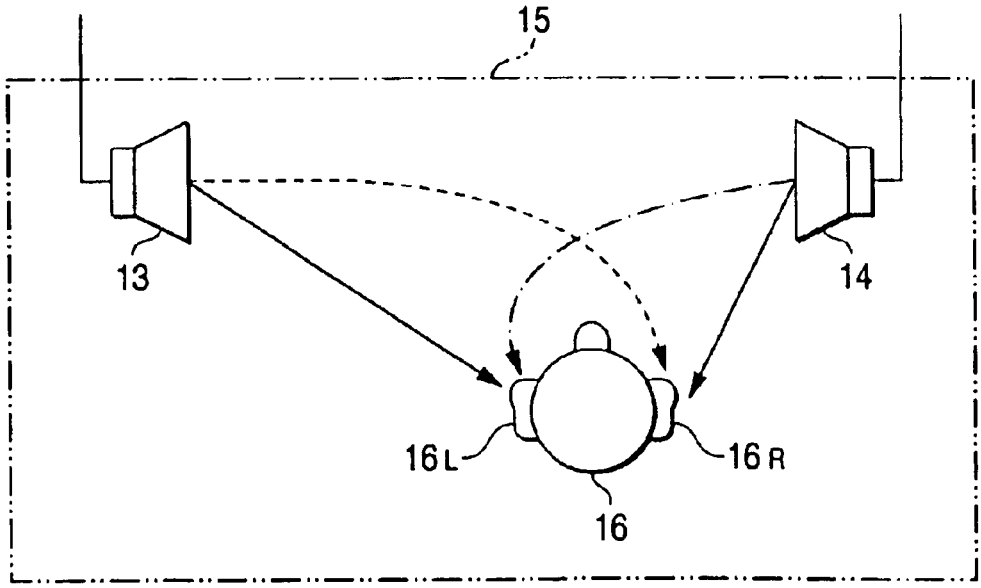
FIG. 3 is an explanatory diagram for further explaining the method of setting the transfer functions of the operator circuits.

Only the left speaker 13 located in an actual car cabin 15 is driven to emit a pulse sound as shown in FIG. 3. A sound which reaches the left ear 16L of a listener 16 and a sound which reaches the left ear 16R are gathered by microphones, respectively. Impulse response series yLL(t) and yLR(t) are measured.

Only the right speaker 14 located in an actual car cabin 15 is driven to emit a pulse sound. A sound which reaches the left ear 16L of the listener 16 and a sound which reaches the left ear 16R are gathered by microphones, respectively. Impulse response series yRL(t) and yRR(t) are measured.

Figure 8A:
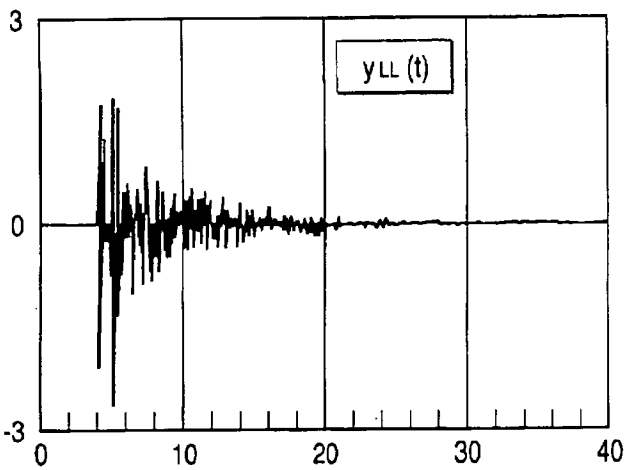
FIGS. 8A to 8D are graph exemplarily showing waveforms of impulse response measured in a car cabin, with the ordinate representing an amplitude of the impulse response and the abscissa representing time.
Figure 8B:
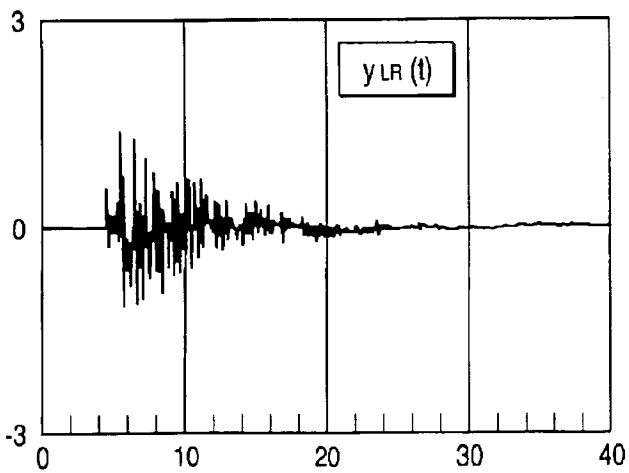
Figure 8C:
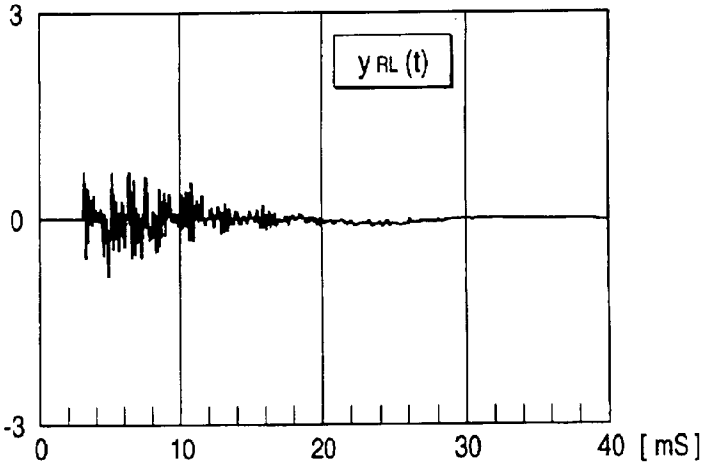
Figure 8D:
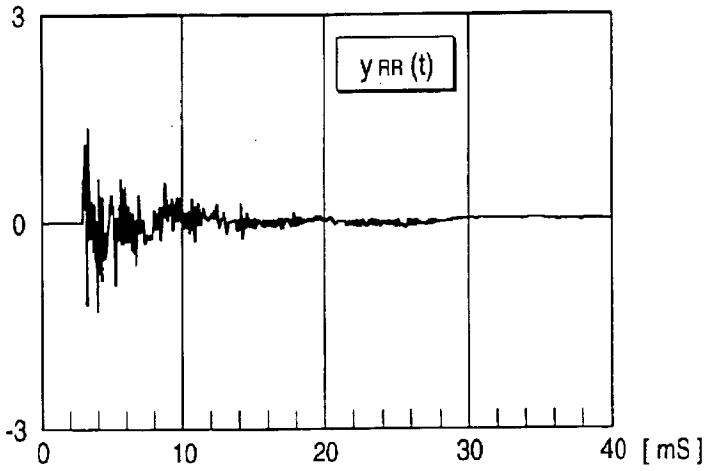

FIGS. 8A to 8*b* show waveforms of impulse response series yLL(t), yLR(t), yRL(t) and yRR(t) thus measured.

Figure 9A:
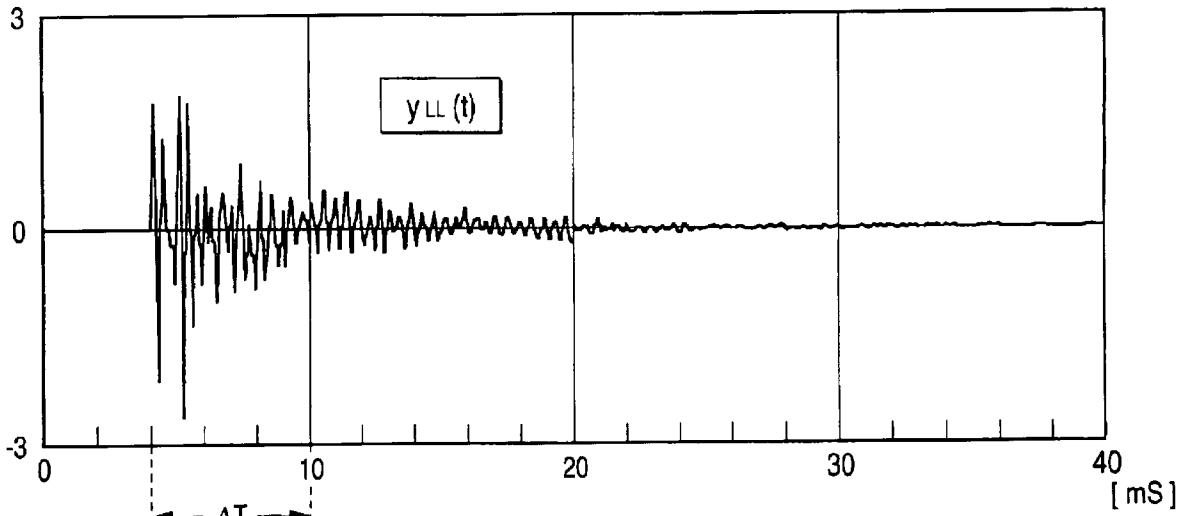
FIGS. 9A and 9B are graph showing waveforms of one impulse response series of FIG. 8 and one impulse response series of FIG. 4.
Figure 9B:
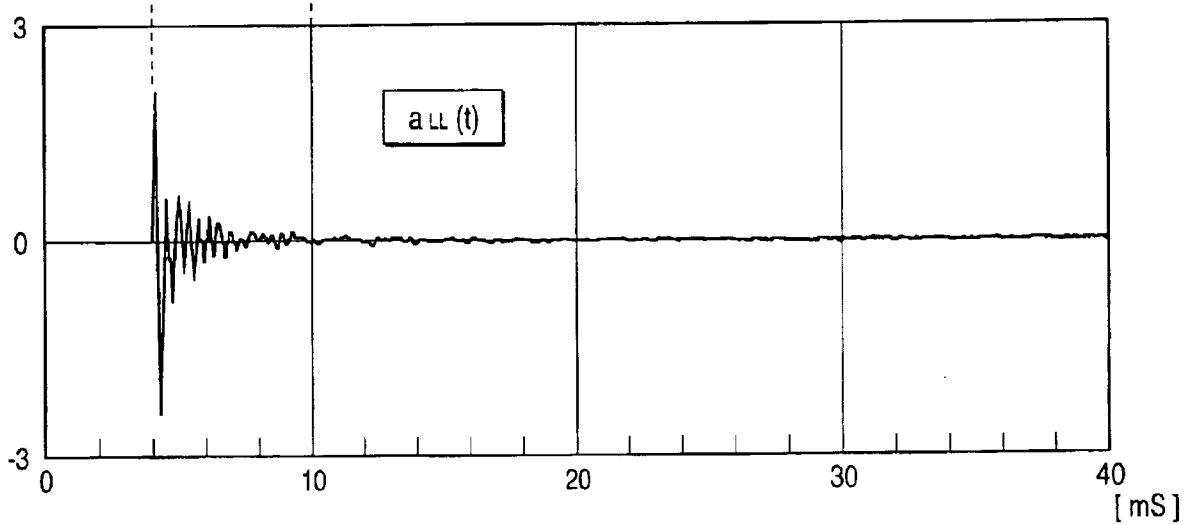
Figure 10A:
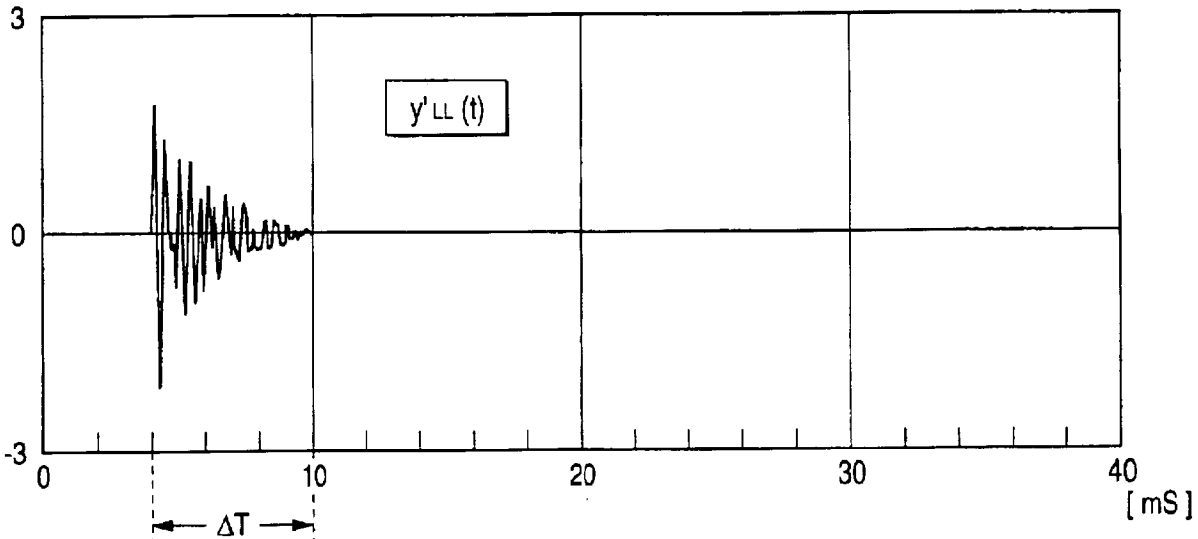
FIGS. 10A and 10B are graph for explaining a setting method of setting operator circuits in a second embodiment of the present invention.
Figure 10B:
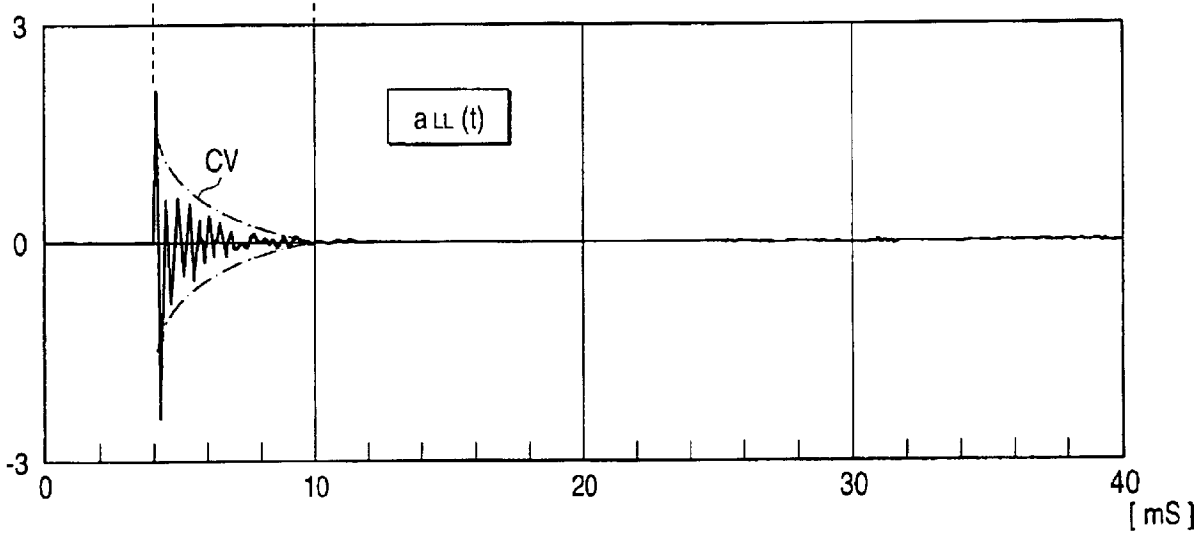

The impulse response series yLL(t) and aLL(t) are compared as shown in FIGS. 9A and 9B. Further, as shown in FIGS. 10A and 10B, the impulse response series yLL(t) is amplitude modulated by an envelope CV within a period ΔT of time taken for the impulse response series aLL(t) to decrease in amplitude to approximately 0 (zero) (viz., a period during which a damping amplitude decreases to approximately 0). In other words, a part of the impulse response series yLL(t) which corresponds to the impulse response series aLL (t) is extracted, and amplitude modulated by the envelope CV to form an impulse response series y'LL(t) as shown in FIG. 10A.

Other impulse response series yLR(t), yRL(t), and yRR(t) are also amplitude modulated in like manner by use of the impulse response series alR(t), aRL(t) and aRR(t) to form amplitude-modulated impulse response series y'LR(t), y'RL (t), and y'RR(t).

Specifically, the impulse response series yLR(t) is amplitude modulated by an envelope of the impulse response series aLR(t)-within a period of time taken for the impulse response series aLR(t) to decrease in amplitude to 0, to thereby form an impulse response series y'LR(t). The impulse response series yRL(t) is amplitude modulated by an envelope of the impulse response series aRL(t) within a period of time taken for the impulse response series aRL(t) to decrease in amplitude to 0, to thereby form an impulse response series y'RL(t). The impulse response series yRR(t) is amplitude modulated by an envelope of the impulse response series aRR(t) within a period of time taken for the impulse response series aRR(t) to decrease in amplitude to 0, to thereby form an impulse response series y'RR(t).

Those impulse response series y'LL(t), y'LR(t), y'RL(t) and y'RR(t) are Fourier transformed into transfer functions (frequency characteristics) YLL, YLR, YRL and YRR.

Then, as in the equations (1) to (5), an inverse matrix Y-1 of a 2-row/2-column regular matrix Y of which the elements are the transfer functions YLL, YLR, YRL, YRR is obtained. The elements of the inverse matrix Y-1 are used as correction transfer functions H11, H12, H21 and H22 of the operator circuits 17 to 20. That is, the transfer functions ALL, ALR, ARL and ARR in the equation (1) are respectively replaced with those transfer functions YLL, YLR, YRL, YRR calculated anew.

The operator circuits 17 to 20 of the correction circuit 10*b* are thus designed. Stereophonic audio signals SL and SR, which are produced by superimposing the head related transfer functions defined when the listener hears a sound in a sound field on the right- and left-channel signals supplied from a sound source, are supplied to the speakers 13 and 14 in a car cabin 15, through the correction circuit 10*b* constructed as mentioned above. In this case, the transfer functions BLL, BLR, BLL and BRR are cancelled (corrected) by the correction transfer functions H11, H12, H21 and H22 of the correction circuit 10*b*, respectively. Therefore, the listener 16 hears sounds equivalent to those reproduced from the audio signals SL and SR on which the head related transfer functions defined when the listener hears in a sound field. Accordingly, the center sound image is localized in front of the listener 16, and the listener hears the sounds in a sound field expanding symmetrically with respect to the listener in the horizontal direction.

Impulse response series yLL(t) to YRR(t) measured in an actual car cabin 15 are amplitude modified by the envelops of impulse response series aLL(t) to aRR(t) measured in an anechoic room 23 as a model of the car cabin 15, to thereby produce impulse response series yLL(t) to yRR(t), respectively. Then, transfer functions YLL to YRR are calculated from those amplitude-modulated impulse response series yLL(t) to yRR(t) Further, the correction transfer functions H11, H12, H21 and H22 of the operator circuits 17 to 20 are set on the basis of the transfer functions YLL to YRR. Therefore, the correction circuit 10*b* may be constructed by use of simple IIR digital filters.

The correction transfer functions H11, H12, H21 and H22 include characteristics, which are featured by the characteristics of the impulse response series yLL(t) to yRR(t), i.e., the sound field characteristics in the actual car cabin 15. Therefore, influence by the transfer functions BLL to BRR in the car cabin 15 shown in FIG. 1 may effectively be corrected.

In the second embodiment, the impulse response series yLL(t) to yRR(t) measured in the actual car cabin 15 are amplitude modulated by the envelops of the impulse response series aLL(t) to aRR(t) measured in the anechoic room 23. It should be understood that many other alterations exist.

In an alteration, parts of the impulse response series yLL(t) to yRR(t) within a period of time taken for the impulse response series aLL(t) to aRR(t) to decrease in amplitude to approximately 0, as of the time period ΔT shown in FIGS. 9 and 10 are directly extracted from those impulse response series, functions H11, H12, H21 and H22 are set on the basis of the transfer functions YLL to YRR obtained from the extracted impulse response series yLL(t) to yRR-(t). In this alteration, there is no need of amplitude modulating the impulse response series yLL(t) to yRR(t) by the envelops of the impulse response series aLL(t) to aRR(t) measured in the anechoic room 23.

However, it is desirable to amplitude modulate the impulse response series yLL(t) to yRR(t) by the envelops of the impulse response series aLL(t) to aRR(t) measured in the anechoic room 23, when considering generation of higher harmonic noise or the like.

It should be understand that the second embodiment described above is presented for ease of understanding the present invention, and hence the invention may be implemented in other many forms. In the description given above, the correction circuit 10*b* is constructed with four operator circuits 17 to 20, and the adder circuits 21 and 22. If required, those circuits may be substituted by a single digital filter. It is evident that alteration, modifications, changes and others in design and specification of the audio device as an implementation of the invention fall within the scope of the invention.

(Third Embodiment)

An audio device which is a third embodiment of the present invention will be described with reference to FIGS. 11 through 16. In those figures, like or equivalent portions are designated by like reference numerals in FIG. 1. The audio device of the second embodiment is well suitable for use in a room of a house (e.g., a living room) 200.

Figure 11:
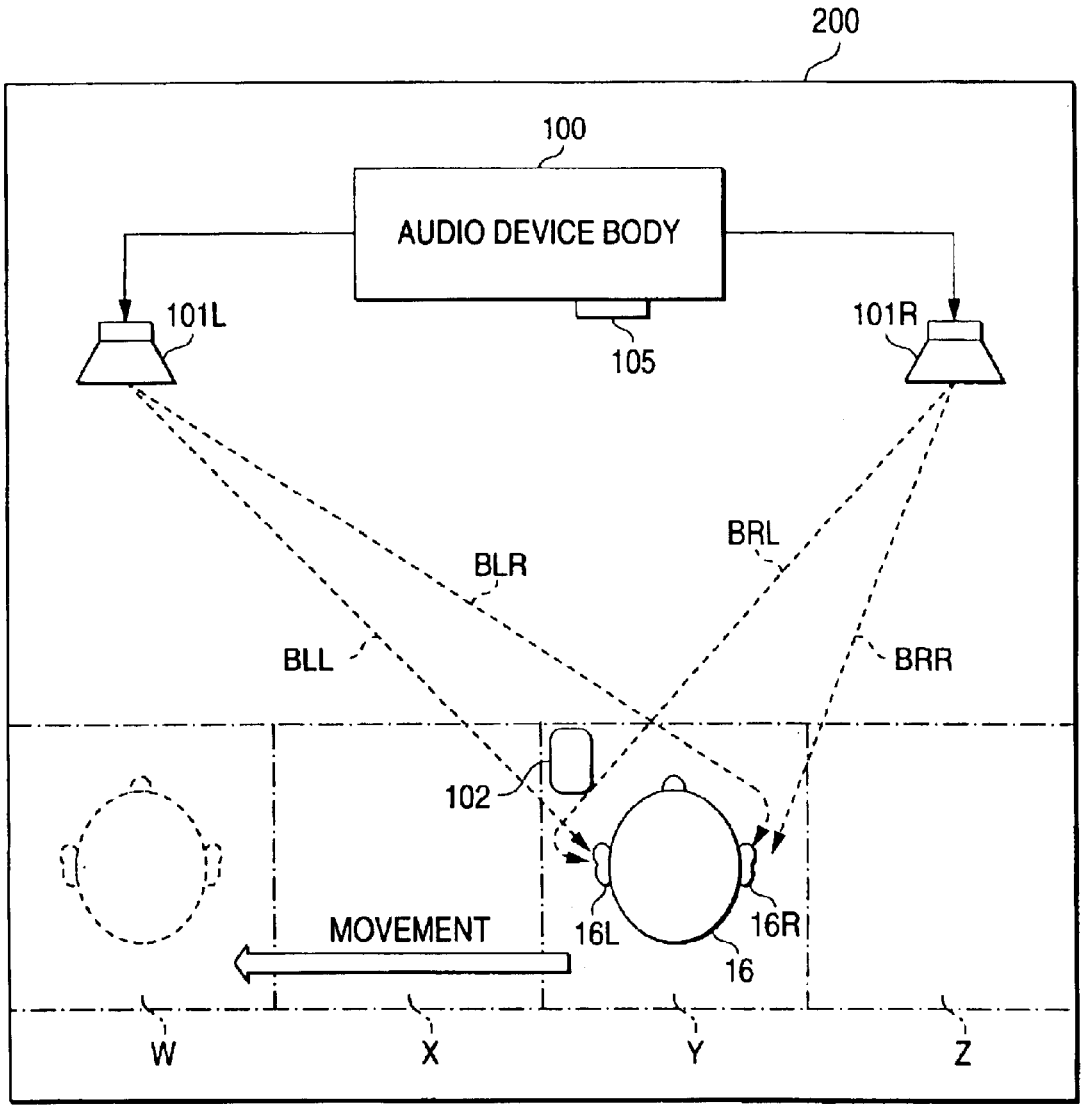
FIG. 11 is a block diagram showing an arrangement of an audio device which is a third embodiment of the present invention.

In FIG. 11, the audio device is made up of an audio device body 100 placed in a room 200 defining a reproduction sound field, right- and left-channel speakers 101L and 101R, and a remote controller 102 operated by a listener 16 for remote control.

The audio device body 100 may be of the unit type in which a CD and/or MD reproduction device for reproducing a recording medium, such as CD or MD, which contains an audio source recorded therein, may selectively be combined into the audio device body or of the integral type in which the unit or units are assembled into a single frame.

Figure 12:
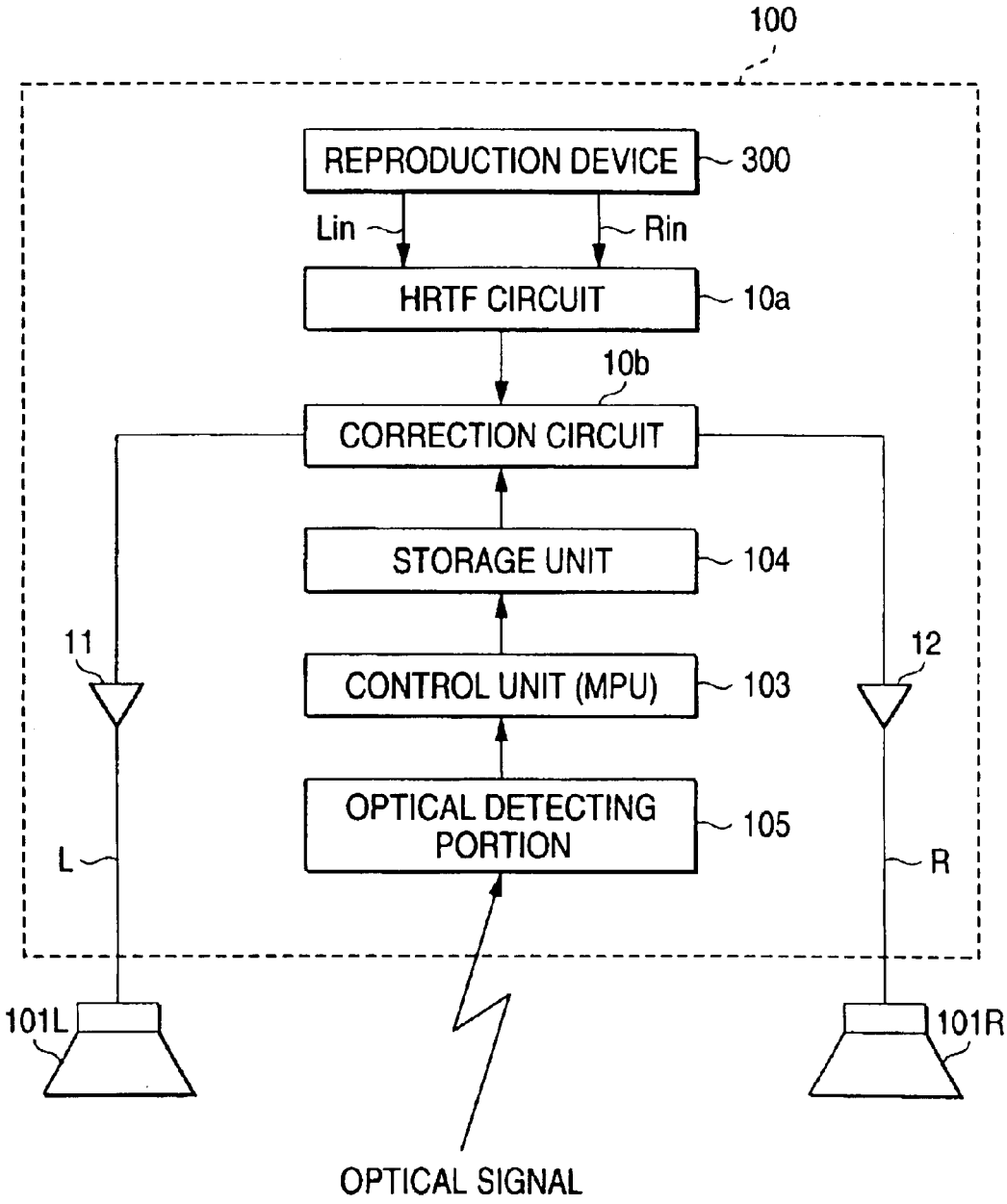
FIG. 12 is a block diagram showing an arrangement of the audio device body in FIG. 11.

The audio device body 100, as shown in a block diagram of FIG. 12, includes a head related transfer function (HRTF) circuit 10*a* which receives right- and left-channel audio signals Lin and Rin, which are reproduced by a reproduction device 300 such as a CD or MD reproduction device, a correction circuit 10*b* and output amplifiers 11 and 12. Further, it includes a control unit 103 with a micro-processor (MPU), a storage unit 104 formed with a re-writable non-volatile semiconductor memory, an optical detecting portion 105 and the like.

In the circuit, the HRTF circuit 10*a*, correction circuit 10*b* and output amplifiers 11 and 12 are substantially equal in construction to those in the FIG. 1 circuit. The audio input signals Lin and Rin are correction processed to generate audio signals L and R, and those signals L and R are applied to left and right speakers 101L and 101R, respectively.

The storage unit 104 stores data for setting the correction transfer functions H11, H12, H21 and H22 of the correction circuit 10*b* as described in the first and second embodiments.

The storage unit 104 stores not only one kind of transfer function data corresponding to one hearing position but also plural kinds of transfer function data {all, aa12, aa21, aa22), (bb11, bb12, bb21, bb22}, {cc11, cc12, cc21, cc22}, and {dd11, dd12, dd21, dd22} corresponding to a plurality of hearing positions W, X, Y and Z, as shown in FIG. 14.

Four transfer data items corresponding to four hearing positions W, X, Y, Z are exemplarily shown in FIG. 14. It is clear that a desired number of hearing positions and different kinds of transfer function data corresponding to them may be used.

The optical detecting portion 105 includes an optoelectric transducing elements which receives an optical signal from the remote controller 102 and converts it into a corresponding electric signal, and supplies the electric signal to the control unit 103.

The control unit 103 detects code data indicative of a hearing position, which is contained in an electric signal derived from the optical detecting portion 105, makes an access to the storage unit 104 to read out the transfer function data in accordance with the detected code data, and transfers the readout data to the correction circuit 10*b*.

When the listener operates a given operation button switch provided on the remote controller 102, the remote controller 102 emits an optical signal containing code data indicative of a hearing position defined by the operation button switch. The control unit 103 makes an access to the storage unit 104 according to the code data and reads out the transfer data corresponding to the code data, and causes the transfer of it from the storage unit 104 to the correction circuit 10*b*. As a result, the transfer functions in the correction circuit 10*b* are updated to or replaced with the transfer functions instructed by the listener.

Figure 13:
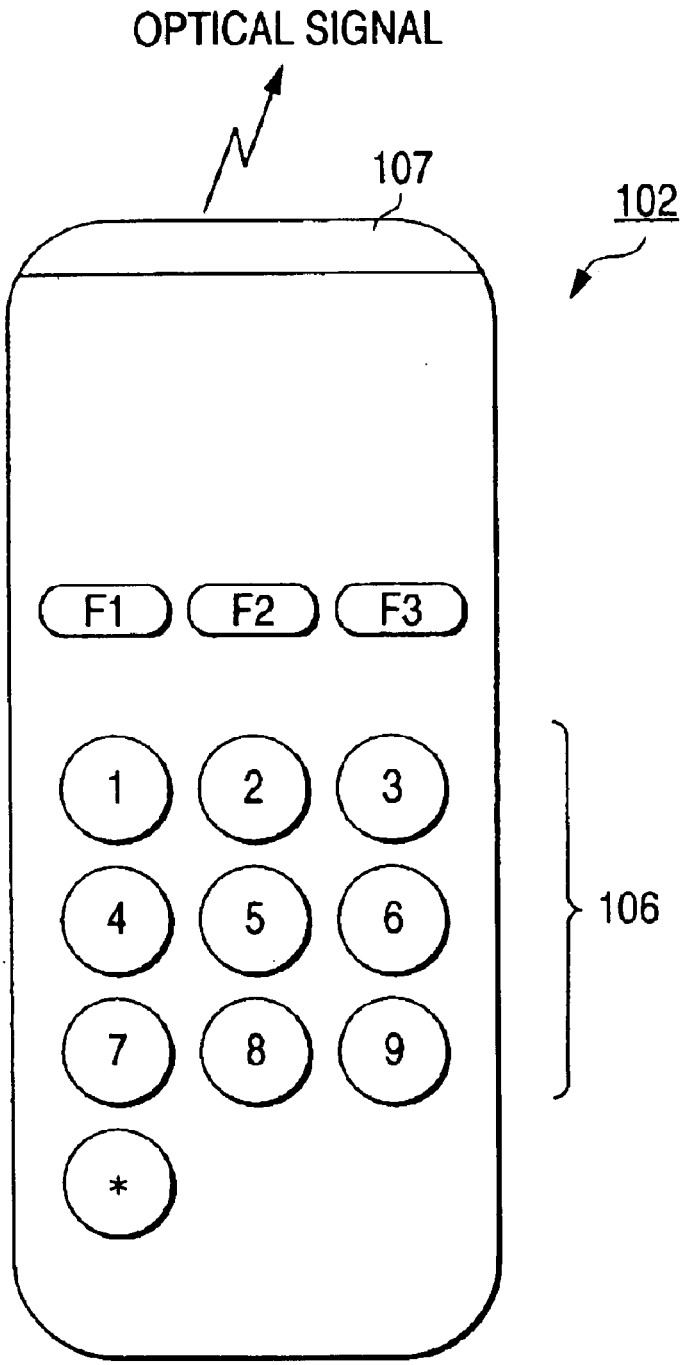
FIG. 13 is a plan view showing an external appearance of a remote controller.

FIG. 13 is a plan view showing an external appearance of the remote controller 102. In the figure, the remote controller 102 includes a plurality of function keys F1 to F3, and ten keys 1–6 specified with numerals. Those keys F1 to F3 and 106 are operation button switches. A light emission portion 107 with an infrared-ray light emitting element which emits an optical signal is provided at the top of the remote controller 102.

A decoder circuit which detects any of the function keys F1 to F3 and the ten keys 106, which is depressed, and generates code data of a hearing position corresponding to the detected key is provided in the frame of the remote controller 102. Further, a modulator circuit which modulates code data indicative of the hearing position output from the decoder circuit, and supplies the resultant to the light emission portion 107. Additionally, a drive circuit which power amplifies the output signal of the modulator circuit and applies the resultant to the infrared-ray light emitting element, and causes the light emission portion 107 to emit light containing the code data, is further provided.

The decoder circuit is designed so as to generate code data of the hearing positions, W, X, Y and Z corresponding to the ten keys 106, as shown in FIG. 15.

When the function key F1 is depressed and then any of the keys (1), (2) and (3) of those ten keys 106 is depressed, it generates code data indicative of a hearing position W. When any of the keys (4), (5) and (6) of those ten keys 106 is depressed, then it generates code data indicative of a hearing position X. When any of the keys (7), (8) and (9) of those ten keys 106 is depressed, then it generates code data indicative of a hearing position Y. When a "*" key is depressed, then it generates code data indicative of a hearing position Z.

The correspondence between those ten keys 106 and the hearing positions is presented by way of example. If required, another correspondence may be employed, as a matter of course.

The function key F1 is provided for updating the transfer functions in the correction circuit 10*b*, viz., for mode selection. The function key F2 is provided for designating the CD reproduction device of the reproduction device 300 and controlling its operation. When the listener depresses the function key F2 and depresses the key (1) of the ten keys 106, a musical piece recorded in the first track of the CD as a recording medium is reproduced.

A method of generating transfer function data stored in the storage unit 104 shown in FIG. 14 will be described.

Right and left speakers are disposed in an anechoic room which is a model of the room 200 as a reproduction sound field. A dummy listener is located at a hearing position in the anechoic room, which corresponds to the hearing position W in the room 200. Pulse sounds emitted from the right and left speakers are gathered by microphones, whereby the impulse response series described in the first and second embodiments are obtained. The transfer function data {aa11, aa12, aa21, aa22} corresponding to the hearing position W is generated in accordance with the impulse response series. The transfer function data {bb11, bb12, bb21, bb22} of the transfer functions defined when a dummy listener is located at a hearing position corresponding to the hearing position X in the room 200 is generated in like manner. The transfer function data {bb11, bb12, bb21, bb22} of the transfer functions defined when a dummy listener is located at a hearing position corresponding to the hearing position Y in the room 200 is generated in like manner. Further, the transfer function data {dd11, dd12, dd21, dd22} of the transfer functions defined when a dummy listener is located at a hearing position corresponding to the hearing position Z in the room 200 is generated in like manner.

Those data pieces of the thus generated transfer functions are made to correspond to the ten keys 106 and the function key F1 on the remote controller 102, respectively. Those transfer function data pieces may be stored in the storage unit 104 in a factory or distributed to users in the form of a semiconductor memory storing those transfer function data pieces.

An operation of the audio device when the listener operates the remote controller 102 in the room 200 will be described.

Let us consider a case where the listener 16 moves to the hearing position Y in the room 200, and depresses the function key F1 on the remote controller 102 and the key (7) of the ten keys 106. In this case, the light emission portion 107 emits light containing the code data of the hearing position Y. The optical detecting portion 105 receives the light, and the storage unit 104 causes the transfer of the transfer function data {cc11, cc12, cc21, cc22} corresponding to the hearing position Y from the storage unit 104 to the correction circuit 10*b*. Then, the transfer function data in the correction circuit 10*b* is updated to the transfer function data {cc11, cc12, cc21, cc22}.

When the transfer functions are thus updated in the correction circuit 10*b*, correction is made of influence by the transfer functions BLL and BLR in a sound field from the left channel speaker 101L to the right and left ears 16R and 16L of the listener 16 who is placed at the hearing position Y, and the transfer functions BRL and BRR in a sound field from the right channel speaker 101R to the right and left ears 16R and 16L of the listener 16 who is placed at the hearing position Y (model diagram of FIG. 11), to thereby localize a sound image in front of the listener 16. As a result, a stereophonic, natural sound is reproduced.

When the listener 16 moves to the hearing position X in the room 200, and depresses the key (4) on the remote controller 102, the transfer functions in the correction circuit 10*b* are updated to the {bb11, bb12, bb21, bb22}, the sound image is localized in front of the listener 16 who is placed at the hearing position X, and a natural sound is reproduced. When the listener 16 moves to the hearing position W, and depresses the key (1) on the remote controller 102, the sound image is localized in front of the listener 16 who is placed at the hearing position W, and a natural sound is reproduced. When the listener 16 moves to the hearing position Z, and depresses the key "*" on the remote controller 102, the sound image is localized in front of the listener 16 who is placed at the hearing position Z, and a natural sound is reproduced.

As described above, in the embodiment, the transfer function data corresponding to the predetermined hearing positions in the room 200 as a reproduction sound field space is stored, and the transfer functions are updated every time the listener changes his hearing position. Therefore, the listener 16 hears a sound in a sound field expanding asymmetrically with respect to the listener in the horizontal direction.

In the third embodiment described above, the listener 16 operates the ten keys 106 on the remote controller 102 to give an instruction of a hearing position to the audio device body 100. Any other suitable technical means may be employed for the same purpose. An example of it is shown in FIG. 16, as a modification of the audio device.

Figure 16:
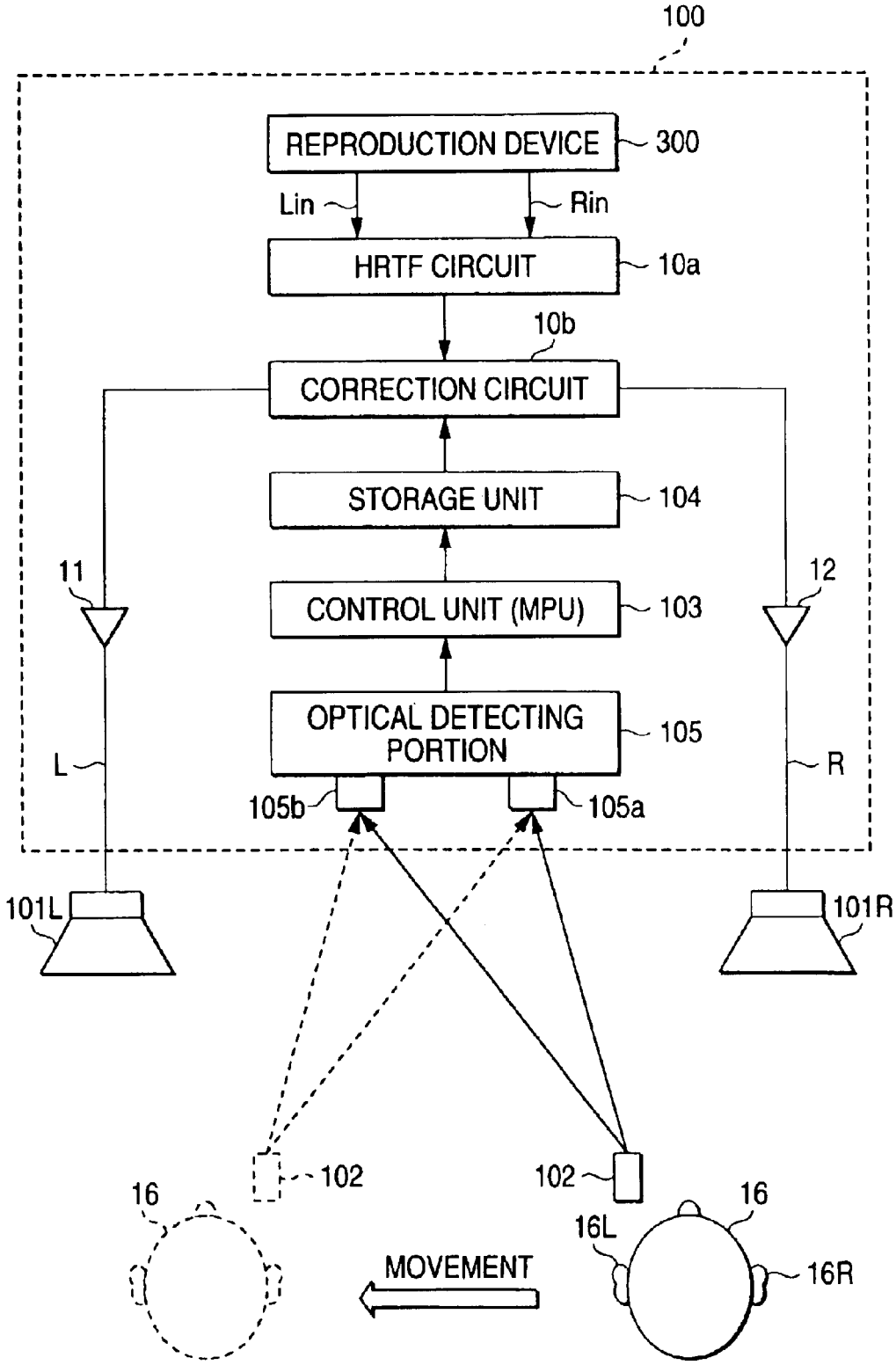
FIG. 16 is a block diagram showing an arrangement of a modification of the third embodiment of the present invention.
Figure 17A:
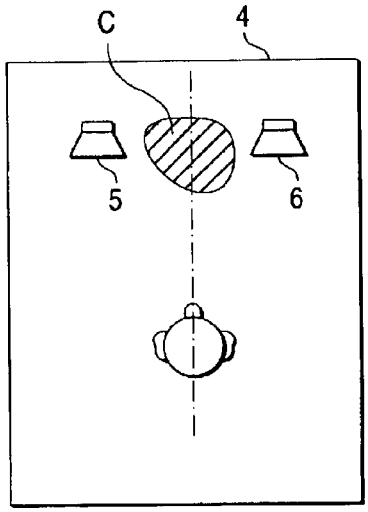
FIGS. 17A to 17D are explanatory diagram for explaining problems of the conventional technique.
Figure 17B:
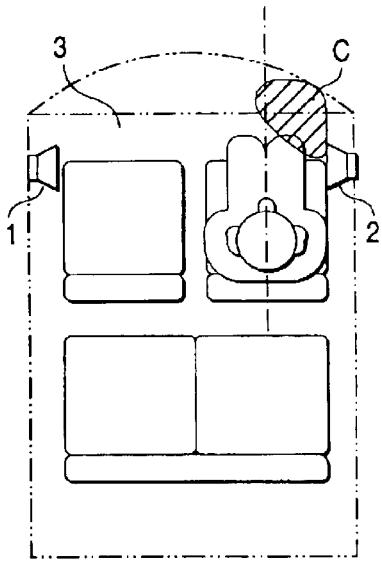
Figure 17C:
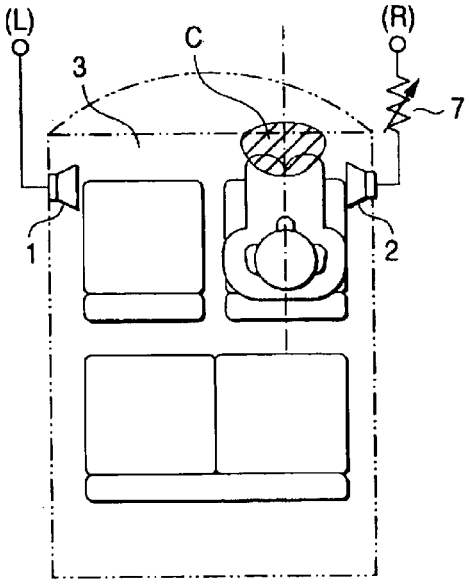
Figure 17D:
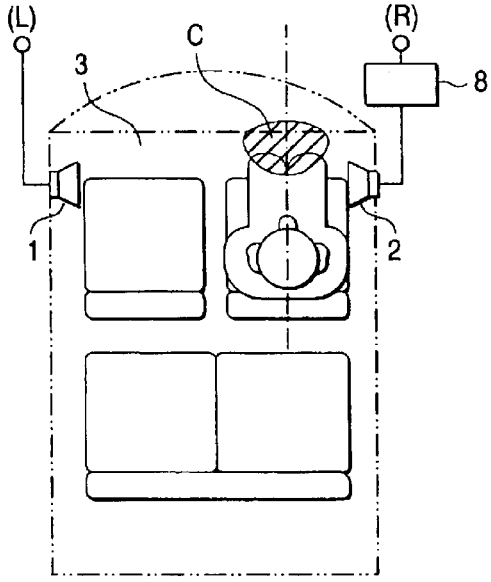

In FIG. 16, a couple of opto-electric transducing element 105*a* and 105*b* are provided while being spaced from each other a predetermined distance. When the listener 16 operates the remote controller 102 at a given position, the light emission portion 107 emits infrared rays. The infrared rays emitted are received by the opto-electric transducing elements 105*a* and 105*b*. The control unit 103 carries out a geometrical operation process about the relative positions of the opto-electric transducing elements 105*a* and 105*b* by use of the light receiving results from the opto-electric transducing elements 105*a* and 105*b*, and judges the present position (hearing position) of the listener 16. Then, it reads out the transfer function data corresponding to the judged hearing position from the storage unit 104 shown in FIG. 4, and updates the transfer functions in the correction circuit 10*b*.

In the audio device thus constructed, there is no need of operating the ten keys 106 on the remote controller 102. Accordingly, if the function key F1 on the remote controller 102 is assigned to the infrared ray emission, the listener 16 may inform the audio device body 100 of the hearing position by a simple operation of merely depressing the function key F1. This leads to improvement of operation facility of the audio device.

While the opto-electric transducing elements 105*a* and 105*b* for receiving light from the remote controller 102 are provided on the audio device body 100, those may be attached to the ends of the right and left speakers 11R- and 101L.

In the third embodiment, the audio device installed in the room 200 of a house or the like is discussed. It is evident that the audio device may be applied to the car-carried audio device.

As described above, in the audio device of the invention, the audio signals of both channels are corrected in advance by a correction circuit (operator circuits) having transfer functions featured by the sound field characteristics in a space between the speakers of both channels and a listener. And the corrected audio signals are supplied to the speakers. Therefore, the listener may hear a sound equivalent to a sound reproduced from the audio signals on which the head related transfer functions defined when the listener hears a sound in a sound field are superimposed. The center sound image is localized in front of the listener, and he hears a sound in a sound field expanding symmetrically with respect to the listener in the horizontal direction.

When the listener changes his hearing position, position detecting means sets the transfer functions based on the hearing position changed. Therefore, the listener hears a sound in a sound field expanding symmetrically with respect to the listener in the horizontal direction is provided to the listener, while being unconscious of the hearing position.

What is claimed:

1. An audio device comprising:

a correction circuit having given transfer functions, which audio device supplies, through said correction circuit, right- and left-channel input audio signals on which head related transfer functions are superimposed, to right- and left-channel speakers located in front of a hearing position of a listener in a reproduction sound field space, wherein said correction circuit includes first to fourth operator circuits, and first and second adder circuits, and correction transfer functions obtained by an inverse matrix of a two-row and two-column matrix of which the elements are the following first to fourth transfer functions are implanted in said first to third operator circuits, said first transfer function is obtained from a third impulse response series, which is extracted from a second impulse response series of a first impulse response series, which said second impulse response series is featured by a sound field characteristic from a left-channel speaker to the listener when said left-channel speaker is disposed in an anechoic room as a model of a component layout in said reproduction sound field space, said first impulse response series being featured by a sound field characteristic of a space ranging from a left-channel speaker to the left ear of the listener when said left-channel speaker is disposed in said reproduction sound field space, said second transfer function is obtained from a sixth impulse response series, which is extracted from a fifth impulse response series of a fourth impulse response series, which said fifth impulse response series is featured by a sound field characteristic of a space ranging from a left-channel speaker to the right ear of the listener when said left-channel speaker is disposed in an anechoic room as a model of a component layout in said reproduction sound field space, said fourth impulse response series being featured by a sound field characteristic of a space ranging from a left-channel speaker to the right ear of the listener when said left-channel speaker is disposed in said reproduction sound field space, said third transfer function is obtained from a ninth impulse response series, which is extracted from an eighth impulse response series of a seventh impulse response series, which said eighth impulse response series is featured by a sound field characteristic of a space ranging from a right-channel speaker to the left ear of the listener when said left-channel speaker is disposed in an anechoic room as a model of a component layout in said reproduction sound field space, said seventh response series being featured by a sound field characteristic of a space ranging from a right-channel speaker to the left ear of the listener when said right-channel speaker is disposed in said reproduction sound field space, and said fourth transfer function is obtained from a 12th impulse response series, which is extracted from an 11th impulse response series of a 10th impulse response series, which said 11th impulse response series is featured by a sound field characteristic of a space ranging from a right-channel speaker to the right ear of the listener when said right-channel speaker is disposed in an anechoic room as a model of a component layout in said reproduction sound field space, said 10th response series being featured by a sound field characteristic of a space ranging from a right-channel speaker to the right ear of the listener when said right-channel speaker is disposed in said reproduction sound field space, and said first adder circuit adds together output signals of said first and third operator circuits when said left-channel input audio signal is input to said first operator circuit, and said right-channel input audio signal is input to said third operator circuit, and said second adder circuit adds together output signals of said second and fourth operator circuits when said left-channel input audio signal is input to said second operator circuit, and said right-channel input audio signal is input to said fourth operator circuit.

2. The audio device according to claim 1, wherein said third impulse response series is extracted from a part of said first impulse response series within a period of time taken for a damping amplitude of said second impulse response series decreases to approximately 0 (zero), said sixth impulse response series is extracted from a part of said fourth impulse response series within a period of time taken for a damping amplitude of said fifth impulse response series decreases to approximately 0 (zero), said ninth impulse response series is extracted from a part of said seventh impulse response series within a period of time taken for a damping amplitude of said eighth impulse response series decreases to approximately 0 (zero), and said 12th impulse response series is extracted from a part of said 10th impulse response series within a period of time taken for a damping amplitude of said 11th impulse response series decreases to approximately 0 (zero).

3. The audio device according to claim 1, wherein said third impulse response series is extracted by a window function in which said first impulse response series is featured by an envelop of said second impulse response series, said sixth impulse response series is extracted by a window function in which said fourth impulse response series is featured by an envelop of said fifth impulse response series, said ninth impulse response series is extracted by a window function in which said seventh impulse response series is featured by an envelop of said eighth impulse response series, and said 12th impulse response series is extracted by a window function in which said 10th impulse response series is featured by an envelop of said 11th impulse response series.

* * * * *